United States Patent [19]

Shiraishi et al.

[11] Patent Number: 4,659,255

[45] Date of Patent: Apr. 21, 1987

[54] MARINE STRUCTURE OF PRECOATED CORROSION RESISTANT STEEL PIPE PILES

[75] Inventors: Motoo Shiraishi, Tokyo; Mansei Tanaka, Chiba; Minoru Nakamura; Koichi Sato, both of Tokyo, all of Japan

[73] Assignee: Nippon Steel Corporation, Tokyo, Japan

[21] Appl. No.: 805,604

[22] Filed: Dec. 6, 1985

Related U.S. Application Data

[63] Continuation-in-part of Ser. No. 633,422, Jul. 19, 1984.

[51] Int. Cl.[4] ..... E02D 5/60; E02B 17/00

[52] U.S. Cl. ..... 405/216; 405/211

[58] Field of Search ..... 405/195, 211, 216, 217; 52/722, 728, 727, 725

[56] References Cited

U.S. PATENT DOCUMENTS

| | | | |
|---|---|---|---|
| 2,470,149 | 5/1949 | Derby | 405/216 |
| 2,791,096 | 5/1957 | Morton et al. | 405/216 |
| 2,874,548 | 2/1959 | Drushel et al. | 495/216 |
| 3,181,300 | 5/1965 | Plummer | 405/216 |
| 3,321,924 | 5/1967 | Liddell | 405/216 |
| 3,370,998 | 2/1968 | Wiswell | 406/216 X |
| 3,417,569 | 12/1968 | Laughlin | 405/216 |
| 3,448,585 | 6/1969 | Vogelsang | 405/216 |
| 3,505,758 | 4/1970 | Willisford | 405/216 X |
| 3,719,049 | 3/1973 | Shaw et al. | 405/216 |
| 4,283,161 | 8/1981 | Evans et al. | 405/216 |
| 4,340,622 | 7/1982 | Kik et al. | 405/216 X |
| 4,415,293 | 11/1983 | Engel et al. | 405/216 |

FOREIGN PATENT DOCUMENTS

| | | | |
|---|---|---|---|
| 465358 | 5/1950 | Canada | 405/216 |
| 7511739 | 4/1976 | Netherlands | 405/216 |
| 1494072 | 12/1977 | United Kingdom | 405/216 |
| 2028405 | 3/1980 | United Kingdom | 405/216 |

*Primary Examiner*—Richard J. Scanlan, Jr.
*Assistant Examiner*—Nancy J. Stodola
*Attorney, Agent, or Firm*—Wenderoth, Lind & Ponack

[57] ABSTRACT

A marine structure comprising steel pipe piles in which the top head, splash zone and tidal zone of each steel pipe pile driven into the sea bed are covered with a polyethylene resinous covering material, and the top head of the steel pipe pile is inserted inside a slab concrete structure, whereby is realized a considerably improvement in the water imperviousness, corrosion resistance, and scratch resistance of the steel pipe piles.

4 Claims, 7 Drawing Figures

MARINE STRUCTURE OF PRECOATED CORROSION RESISTANT STEEL PIPE PILES

CROSS REFERENCE TO THE RELATED APPLICATION

The present invention is a continuation-in-part application of application Ser. No. 633,422, filed July 19, 1984.

BACKGROUND OF THE INVENTION

1. Field of the Invention

The present invention relates to a marine structure comprising precoated corrosion resistant steel pipe piles for use in ports, harbors, the ocean, and rivers.

2. Description of the prior art

Steel pipe piles have been heretofore employed as foundation piles of a building on land and in harbors and river embankments and piers, and further, with regard to marine structures, have widely been used as steel building materials able to cope with deep water and poor ground.

In general, steel pipe piles for use in harbors, the sea, and rivers have been heretofore used without any covering. In recent years, however, harbor, sea and river structures are required to possess a durability over extended periods of 40 to 50 years.

It has thus become necessary to take anticorrosion measures enabling the steel pipe piles used in such harshly corrosive environments to maintain their corrosion-resistance for extended periods of time.

Various methods for preventing the corrosion of steel pipe piles have been known, such as use of a coating of tar-epoxy, electrical protection, and a mortar coating method employing fiber reinforced plastic (hereinafter referred to as FRP).

For instance, U.S. Pat. No. 3,417,569 discloses a protective coating for a steel pipe piling to be employed as an off-shore platform. The protective coating is said to protect the steel pipe piling from corrosion in the so-called splash zone, where corrosion is particularly severe. The coating is preferably a chloroprene polymer with a preferred thickness of $\frac{1}{8}$ to 1 inch.

U.S. Pat. No. 2,874,548 discloses a steel piling for marine use surrounded by a layer of sealing material such as heavy dielectric grease or asphalt which, in turn, is surrounded by an imperforate cylindrical sleeve having high resistance to corrosion.

U.S. Pat. No. 2,791,096 discloses that the portion of a steel pile structure immersed in the splash and tidal zones is covered with a Monel (nickel-copper alloy containing 20–40% copper) sheet sheathing, and is cathodically protected from corrosion by the sea water below low tide by an anode electropositive to the steel structure.

U.S. Pat. No. 3,181,300 discloses the application of a thermoplastic flexible impervious sheet material in order to cover and embrace a steel pile therewith and further discloses bonding the joint of the thermoplastic sheet.

U.S. Pat. No. 3,321,924 discloses a method for protectively encasing a pile in situ which comprises forming a sheet of synthetic plastic material into a roll having a diameter less than the diameter of said pile, and expanding said roll about said pile, said roll contracting into close engagement with said pile, securing said roll to said pile, and sealing the space between said pile and said roll.

U.S. Pat. No. 3,370,998 relates to a method for preventing submerged pile structure from corrosion by sandblasting the corroded exterior thereof, preparing an epoxy resin sheet forming tray, and removing the resin sheet from the tray, and securing it to a plate so that the sheet and the plate may be applied to the pile.

U.S. Pat. No. 3,448,585 relates to a protective shield for pilings formed from a sleeve of heat-shrinkable plastic material encircling such pilings along the length thereof and heat-shrunk into tight encircling engagement about the piling to protect it from rot, rust, erosion, corrosion, insects or mechanical damage.

U.S. Pat. No. 3,505,758 relates to an antifouling protective cover for preventing the growth of marine organisms on the exterior of marine objects submerged in the sea water, and the cover consists of a double-wall, rubber-coated fabric reservoir which carries a diffusible toxic material.

U.S. Pat. No. 4,340,622 discloses that the blistering of an organic coating composition applied to a surface disposed adjacent to a body of water is avoided by applying the coating composition to the surface while water is flowing over the surface.

U.S. Pat. No. 4,283,161 relates to the method for protection of offshore flow line risers and existing platforms by wrapping such risers and platforms with a flexible membrane such as rubber, to protect such structures from damage due to waves and from biological growth.

U.S. Pat. No. 4,415,293 relates to the method for preventing marine growth on the shallow water portions of platform legs by applying a polymer coating to the legs and covering the polymer with a copper-nickel alloy anti-fouling covering. The legs are provided with sheaths made of copper-nickel alloy.

Canadian Pat. No. 465,358 relates to a pile which consists of a wood column surrounded by a concrete jacket. The wood column is provided with a plurality of annular notches, each of which is occupied by concrete rings formed integrally with the concrete jacket.

British Pat. No. 1,494,072 discloses that a structure partially immersed in water is protected against corrosion by placing a jacket around the structure and removing water from the space between jacket and structure. Polyurethane foam is injected into the space and sets to form a protective coating.

Netherlands Pat. No. 7,511,739 discloses a doubly coated steel pile having an internal layer of, for example, bitumen and an external layer of e.g. polyethylene. The tar-epoxy coating method is troublesome because it has to be repeated every few years. Furthermore, extended corrosion resistance cannot be expected, as even if the steel pipe pile is coated with the tar-epoxy before it is driven into place, the coating is soft and tends to be scratched when being handled or driven. In addition, after having been driven into place, it may be struck by driftwood or the like, causing damage to the coating, making the pile more susceptible to corrosion at that point. Moreover, if the steel pipe pile is coated with the tar-epoxy after it is driven into place, it follows that only the part above the water will be protected from corrosion. If the underwater portion of steel pipe pile is to be coated, the cost therefor would become very high because of the necessity of having to drain the water from around the pile.

On the other hand, however, the electrical corrosion protection measure is disadvantageous in that the electrochemical function is such that corrosion protection is difficult in the splash zone and the tidal zone, where steel corrosion develops most rapidly.

Corrosion of steel materials in harbors, seawater and rivers proceeds most rapidly in the splash zone and the tidal zone, and is slower underwater, and slower still on sea mud.

"Splash zone" in this specification refers to the portion above the mean high water mark obtained from the high point of the highest tide; "tidal zone" refers to the zone between the mean high water mark and the mean low water mark; and "seawater zone" refers to the portion below the mean low water mark.

According to a recent study on the corrosion rate of steel structures in harbors conducted by an official organization, the average corrosion rate of steel pipe pile is 0.37 mm/year to 0.6 mm/year in the splash zone, and 0.35 mm/year to 0.5 mm/year in the tidal zone and thereabout. It was found that the mean corrosion rate in the seawater zone tends to gradually decrease as the depth of the seawater increases, and it is less than 0.05 mm/year.

It was also reported that the corrosion rate was 0.1 mm/year to 0.05 mm/year in a riprap layer, 0.05 mm/year in sea sludge, and 0.01 mm/year to 0 mm/year in the sea mud.

Assuming a mean corrosion ratio of 1.0 in the splash zone and the tidal zone, the corrosion ratio in the seawater zone amounts only to about 1/10, and to only about 1/50 in the sea mud.

It follows from the above that electrical protection of corrosion is hardly effective for the steel pipe pile in the splash zone and the tidal zone where protection against corrosion is most desired. Consequently, as a very effective means for preventing corrosion in the splash and tidal zones, where corrosion is most marked, the following method has recently been proposed.

FIG. 1 of the accompanying drawings shows an embodiment of a conventional method of preventing corrosion.

In FIG. 1, in a steel pipe pile 1 driven into the sea bed 3, a FRP tubular cover 9 encloses the splash zone 4, the tidal zone 5, and part of the outer surface of the pile just below the tidal zone 5, with the space between the tubular cover 9 and the steel pipe pile 1 being filled with mortar 10. The lower end of the mortar 10 is covered by an anti-corrosion seal means 11. In FIG. 1, 7 is a concrete structure and 8 is a riprap layer.

FIG. 2 is an enlarged view of the principal portion of FIG. 1. To carry out the work of FIG. 1, a specialist, such as a diver, is required, and since the work is affected considerably by waves, tides, and other such marine conditions, the method is disadvantageous in that the working efficiency is so poor that there is insufficient waterproofness along the boundary between the concrete structure built onto the top of the steel pipe pile and the mortar filling. Moreover, the cost is high.

SUMMARY OF THE INVENTION

It is an object of the invention to provide a marine structure in which precoated corrosion-resistant steel pipe piles are employed.

Other and further objects of the invention will become apparent from the following description made with reference to the accompanying drawings.

DETAILED DESCRIPTION OF THE INVENTION

Figure 1:
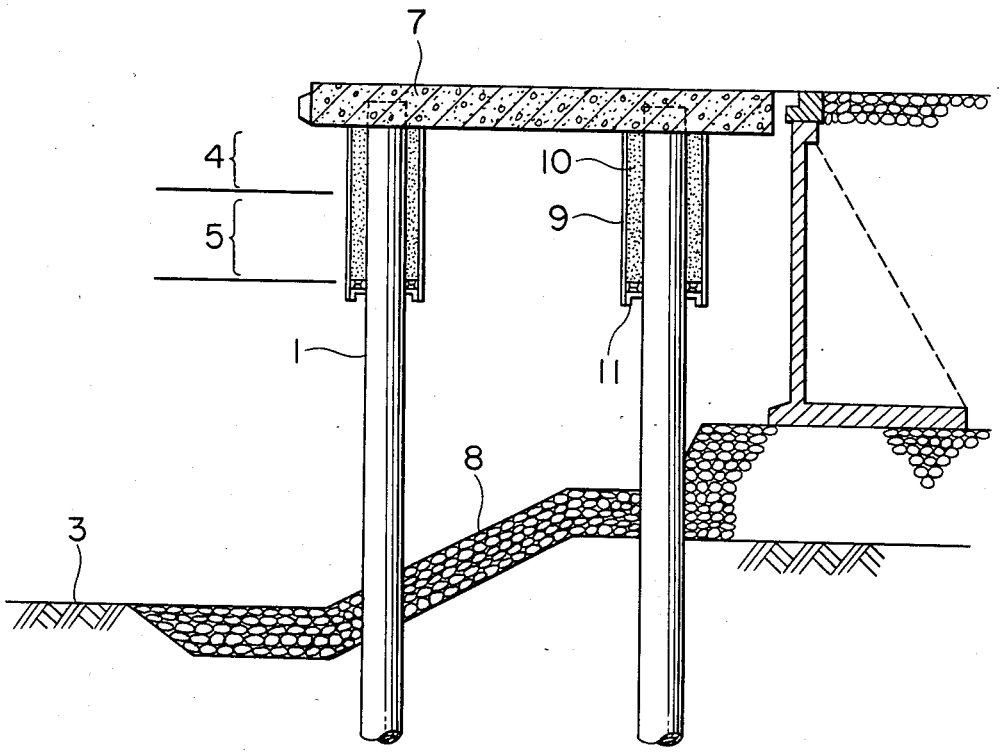
FIG. 1 (PRIOR ART)
FIG. 1 is a side view of a conventional method for the prevention of corrosion of steel pipe piles.
Figure 2:
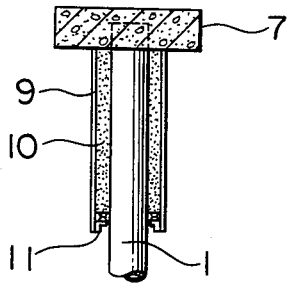
FIG. 2 (PRIOR ART)
FIG. 2 is an enlarged view of a principal part of FIG. 1.
Figure 3:
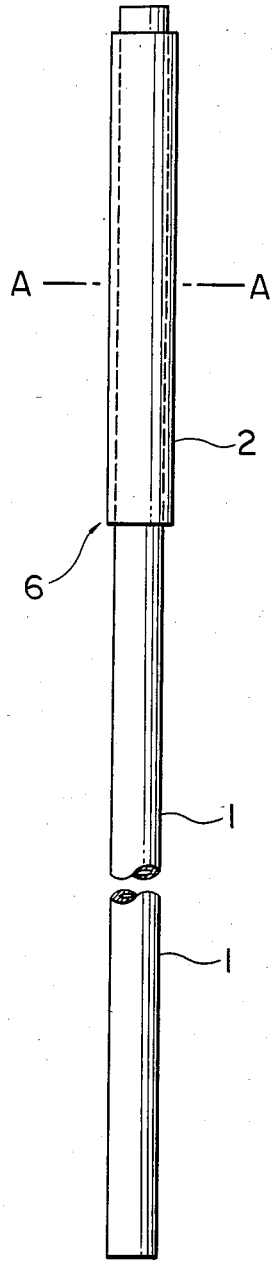
FIG. 3 is a side view of a steel pipe pile according to this invention.

The present invention relates to a structure employing steel pipe piles, wherein the steel pipe pile to be driven into the sea bed is previously coated with a polyethylene resin material (hereinafter referred to as "coating material") to provide corrosion-resistance at least in the tidal zone and splash zone.

FIGS. 3–6 show an embodiment of the invention.

The splash zone 4, tidal zone 5, and a portion of the surface extending slightly below the tidal zone of a steel pipe pile to be driven into the sea bed 3 are all covered with a coating material 2. The lower end of a corrosion-resistant steel pipe pile 6 thus constructed is driven into the sea bed 3. A concrete structure 7 consisting of concrete slabs, such as a pier or jetty, is then constructed on the top of the corrosion-resistant steel pipe piles 6. That is, after the concrete structure has been built up, the upper part of the coating material 2 of the corrosion-resistant steel pipe piles is located inside the concrete structure 7.

Thus, unlike the conventional methods of preventing corrosion of steel pipe piles, the corrosion-resistant steel pipe pile of the present invention is coated in the factory with the coating material 2 to the extent required for the design. Thus, the steel pipe pile can be proofed against corrosion surely and easily. In particular, the portion around the steel pipe pile and the concrete structure can be prevented from any corrosion resulting from the splashing of seawater by coating the head of the steel pipe pile which is inserted into the concrete structure.

The thickness of the coating material 2 of this invention should be in the range of 1.5–4.5 mm. When the oxidizing rate of the steel surface covered with polyethylene is taken into consideration, the lower limit for the thickness of the coating material 2 is 1.5 mm. Moreover, when scratches sustained during driving of the steel pipe pile, handling scratches, possibility of impact from driftwood, abrasion by drift sand, and other unpredictable factors are taken into account, the thickness of the polyethylene layer is preferred to be at least 2–3 mm.

The corrosion resistant steel pipe pile of the present invention can be applied in combination with cathodic protection.

There are two cathodic protection methods; the sacrificial anode method and the power impressed method. Nowadays, the sacrificial anode method is generally used because of its advantages in terms of construction method, maintenance, and service life.

In the sacrificial anode system, the anode is consumed with the generation of an anodic current. An aluminum alloy anode is widely used because the rate of consumption is relatively small while the amount of electric current generated per unit weight is large.

For instance, according to a known design standard, it is estimated that the aluminum alloy is consumed at the rate of 0.1 $A/m^2$ in the sea water over the assumed 20-year service life of the steel pile. It should be noted that the sacrificial anode system is only effective in the water medium.

In accordance with the present invention, the steel pipe pile is provided with the polyethylene resin layer at least at the portion of the pile in contact with the splash and tidal zones of the sea level, and the sacrificial anode means is applied at a position below the above zones. Therefore the length of the polyethylene resin layer along the surface of the pile should be determined in view of the high water level and low water level, and more particularly, it should extend 0.5–1.0 m below the low water level.

In the illustrated embodiment of the present invention, cathodic electrical corrosion protection is provided for the portion a of the pile between the portion coated with the covering material 2 and the sea bed 3. It is known from experience, however, that the cathodic protection system can alternatively be provided for the entire portion b below the coating material 2.

Figure 6:
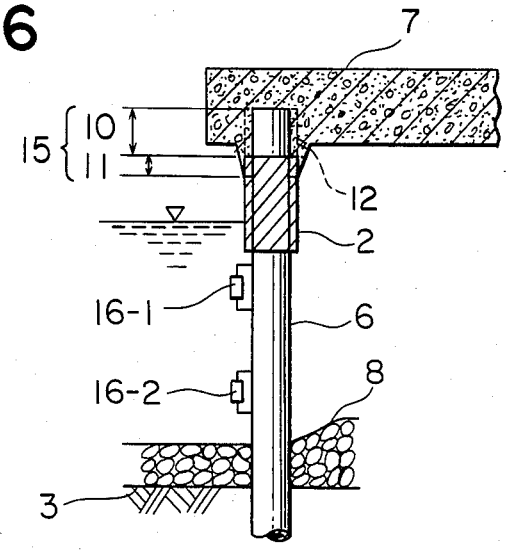
FIG. 6 is a partly longitudinal sectional view of an embodiment of the present invention wherein steel pipe piles of the invention are used.

FIG. 6 is a detailed view showing how the slab concrete structure 7 is joined with the corrosion resistant steel pipe pile.

More than 60% of the cement composition of the concrete structure 7 consists of CaO, which hydrates to form alkaline $Ca(OH)_2$.

In this invention, the top head 15 of the corrosion resistant steel pipe pile 6 consists of a portion 10 having no polyethylene coating and another portion 11 covered with polyethylene. The top head 15 is inserted into a recesses 12 in the concrete structure 7.

Figure 4:
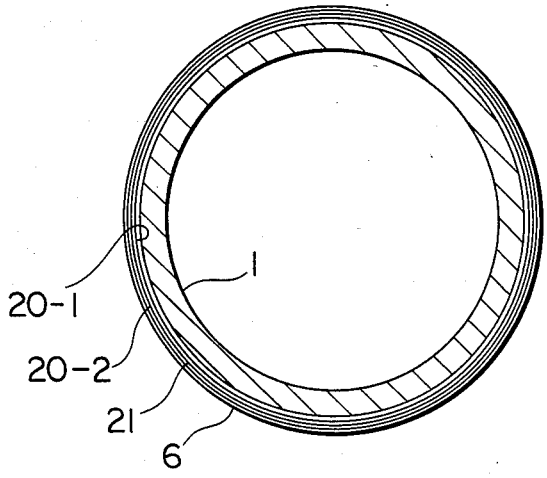
FIG. 4 is an enlarged cross-sectional view through the line A—A of FIG. 3.
Figure 5:
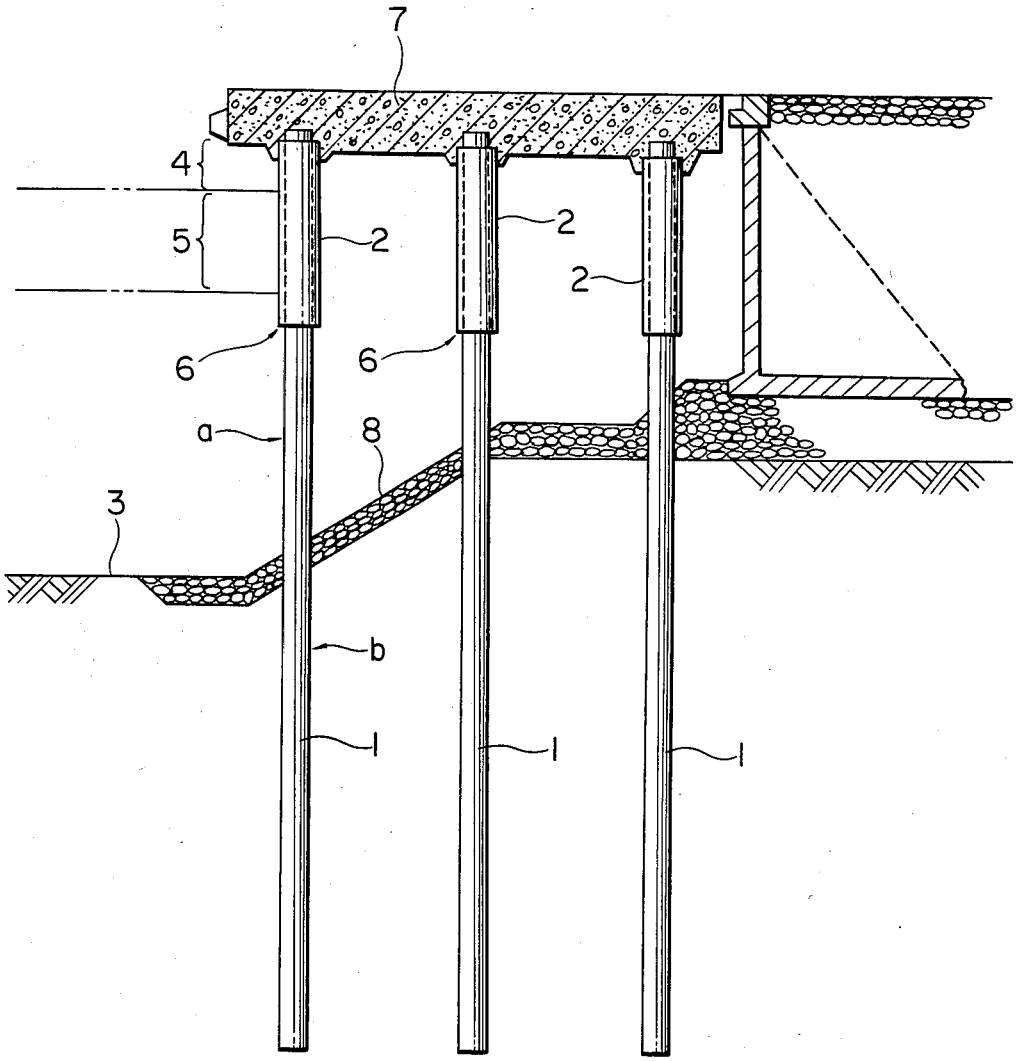
FIG. 5 is a longitudinal sectional view of part of an embodiment of the present invention wherein steel pipe piles of the invention are used to support a concrete structure.

As shown in FIG. 4, the corrosion resistant steel pipe pile 1 has two primer layers 20-1 and 20-2, an adhesive layer 21, and a polyethylene layer 6. The shear adhesive strength of the joint formed in the recess 12 between the concrete structure 7 and the steel pile 6 is an important factor as regards prevention of the penetration of seawater.

Figure 7:
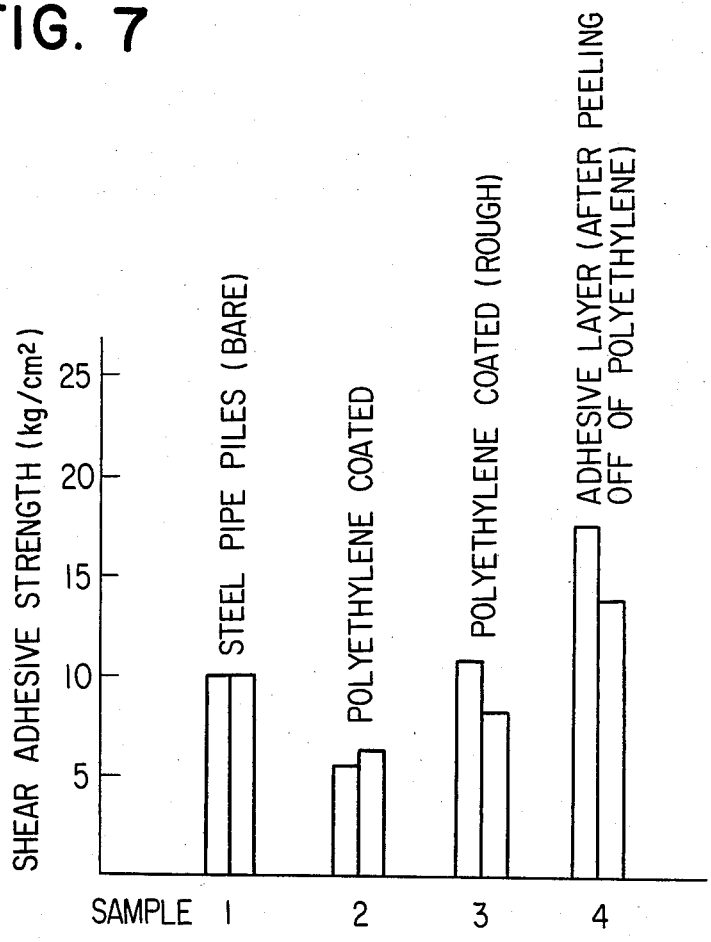
FIG. 7 is a graphic view showing the shear adhesive strength between steel pipe samples and a slab concrete structure.

FIG. 7 shows the results of tests conducted on every two steel pipe pile samples. The shear adhesive strength test showed the strength of sample 2 (covered with polyethylene resin) to be about 7 $kg/cm^2$ or about 70% that of the sample 1 (steel pipe pile with adhering rust). Sample 3 (polyethylene coating abraded with belt sander to form a rough face) showed about the same strength as sample 1. In contrast, sample 4 (polyethylene coating peeled to expose only the adhesive layer) showed an adhesive strength of more than 15 $kg/cm^2$ of adhesion. From this, it will be understood that when the polyethylene coating of the steel pipe pile is peeled off, almost all of the adhesive layer remains, making it possible to obtain a shear adhesion strength on the level of that of the sample 4 in FIG. 7. In other words, it is possible to realize an adhesive strength equal or even larger than that obtainable with a steel surface.

Accordingly, in the present invention, the joint with the concrete structure 7 is made both a 15–30 cm section of the steel pile 6 which has been removed of the polyethylene coating and a 5–10 cm section thereof that remains covered with the polyethylene coating.

Anodes 16-1, 16-2 of the sacrificial anode system are preferably made of an aluminum alloy, and the sacrificial anodes 16-1, 16-2 are fixed on the bare or uncovered portion of the steel pipe pile 6 having no polyethylene coating in order to prevent the pile 6 from corrosion by the known cathodic protection.

The size of the aluminum alloy anodes can be determined on the basis of the area of a bare portion of the underwater steel pipe pile, and anodes of the thus determined size can be positioned at desired places on the pile.

Instead of providing the above cathodic protection, the steel pipe pile can be given an extra wall thickness beyond that dictated by design requirements. The amount of extra wall thickness to be provided can be determined on the basis of the anticipated amount of corrosion.

The coating material 2 of the present invention has excellent resistance to acids and chemicals, hence the steel pipe pile is protected from corrosion even if industrial wastes containing acidic substances and chemicals are disposed of around it.

That is, the steel pipe pile according to this invention can withstand the corrosive action of acidic soils of pH 5 or less, and also has high resistance to the soils wherein anaerobic bacteria, such as sulphate reducing bacilli are present.

The durability of the coating material 2 to weather, corrosion or scratching can be further improved by the addition of carbon black, which intercepts ultraviolet rays, and an anti-oxidant consisting of phenolic or sulphur compound.

Examples of the composition of the coating material 2 are shown as follows:

EXAMPLE 1

Polyethylene resin: 97.2 wt%
Carbon black: 2.6 wt%
Phenolic anti-oxidant: 0.2 wt%

EXAMPLE 2

Polyethylene resin: 96.9 wt%
Carbon black: 2.8 wt%
Phenolic anti-oxidant: 0.3 wt%

The properties of the polyethylene resin are: density 0.915–0.970 $g/cm^3$; melt index 0.05–0.5 g/10 min. Use of a copolymer comprising vinyl acetate, butene, hexene, and polyethylene is preferable. A polyethylene resin having a density of 0.915–930 $g/cm^3$ and a melt index of 0.05–0.15 g/10 min. are most preferred.

The corrosion-resistant steel pipe pile of this invention is produced as follows. The coating material of this invention is continuously extruded in a semi-molten strip from the T-die of an extruding machine.

On the other hand, the steel surface of the pile is subjected to a blasting treatment up to the degree of SIS Sa 2½, preheated and coated with two layers of the primer, and then coated with an adhesive agent. The coating material is spirally applied around the steel pipe pile in such manner that each turn after the first partially overlaps the preceding one. Immediately after application of the coating material, the steel pile is subjected to finish pressure forming by a finish pressure forming roll in order to attain a uniform thickness of the coating material over its necessary portion.

Thus, the corrosion resistant steel pipe pile of the present invention comprises two layers of the primer, an adhesive layer, and a polyethylene resin layer.

In accordance with the present invention, the steel pipe pile 1 can be effectively protected from corrosion at least in the tidal zone and the splash zone for an extended period of time by the use of the coating material 2 with its waterproof property and resistance to corrosion and scratching. Moreover, since the steel pipe pile 1 has been already coated on its outer surface with the coating material 2 before it is driven into place at the job site, required quality maintenance can be fully realized. Further, as the coating material 2 is strong, it is not easily damaged during handling or by the impact of floating driftwood.

The steel pipe pile of this invention can be applied in conventional pile-driving as such, hence no underwater work for anti-corrosion is required after the pile has been driven. In addition, there are economical advantages such as that the coating material 2 is highly durable and thus requires no maintenance.

In addition, the steel pipe pile of the present invention is characterized by the provision of the cathodic protection system on the remaining portion of the pile not covered with the polyethylene resin material so that greater effectiveness of corrosion prevention and extended durability are assured.

We claim:

1. In a marine structure comprising a corrosion resistant steel pipe piling and a concrete slab supported by said piling, said piling comprising a top head portion, splash zone portion and tidal zone portion, said top head portion being inserted into said concrete slab the improvement wherein said top head portion comprises a lower zone and an upper zone, said lower zone, being coated with a coating layer comprising in sequence a primer layer, an adhesive layer and a polyethylene resin layer, said polyethylene resin layer having a thickness of 1.5 to 4.5 mm., the upper zone being coated with only said primer layer and said adhesive layer, all of said upper zone and a part of said lower zone being inserted into said concrete slab.

2. The marine structure as claimed in claim 1 in which said upper zone is 15–20 cm. and said lower zone is 5–10 cm.

3. The marine structure as claimed in claim 1 wherein coating in said lower zone extends to said splash zone portion and tidal zone portion.

4. The marine structure as claimed in claim 3 in which said upper zone is 15 to 20 cm and said lower zone is 5 to 10 cm.

* * * * *

UNITED STATES PATENT AND TRADEMARK OFFICE

CERTIFICATE OF CORRECTION

PATENT NO. : 4,659,255

DATED : April 21, 1987

INVENTOR(S) : Motoo Shiraishi et al.

It is certified that error appears in the above-identified patent and that said Letters Patent is hereby corrected as shown below:

Claim 2, line 2, change "15-20cm." to --15 to 30 cm--.
Claim 4, line 2, change "15 to 20 cm" to --15 to 30 cm--.

Signed and Sealed this

Eighth Day of December, 1987

*Attest:*

DONALD J. QUIGG

*Attesting Officer*

*Commissioner of Patents and Trademarks*